United States Patent [19]

Tobioka et al.

[11] Patent Number: 4,769,070

[45] Date of Patent: Sep. 6, 1988

[54] HIGH TOUGHNESS CERMET AND A PROCESS FOR THE PRODUCTION OF THE SAME

[75] Inventors: Masaaki Tobioka; Yasuhiro Shimizu; Kazutaka Isobe; Nobuyuki Kitagawa; Toshio Nomura; Kunihiro Takahashi, all of Itami, Japan

[73] Assignee: Sumitomo Electric Industries, Ltd., Osaka, Japan

[21] Appl. No.: 91,953

[22] Filed: Sep. 1, 1987

[30] Foreign Application Priority Data

| | | | |
|---|---|---|---|
| Sep. 5, 1986 | [JP] | Japan | 61-210442 |
| Oct. 9, 1986 | [JP] | Japan | 61-240898 |
| Mar. 24, 1987 | [JP] | Japan | 62-69674 |
| Jul. 22, 1987 | [JP] | Japan | 62-181199 |

[51] Int. Cl.[4] ..... C22C 29/04

[52] U.S. Cl. ..... 75/238; 75/244; 419/13; 419/16

[58] Field of Search ..... 75/244, 238; 419/13, 419/16

[56] References Cited

U.S. PATENT DOCUMENTS

| | | | |
|---|---|---|---|
| 3,994,692 | 11/1976 | Rudy | 419/13 |
| 4,049,876 | 9/1977 | Yamamoto et al. | 419/13 |
| 4,120,719 | 10/1978 | Nomura et al. | 419/13 |
| 4,277,283 | 7/1981 | Tobioka et al. | 75/238 |

*Primary Examiner*—Stephen J. Lechert, Jr.

*Attorney, Agent, or Firm*—Wenderoth Lind & Ponack

[57] ABSTRACT

High hardness and high toughness nitrogen-containing sintered hard alloys or cermets useful for cutting tools, in particular, high speed cutting are provided which comprises a hard dispersed phase consisting essentially of a mixed carbonitride of titanium and at least one element selected from the group consisting of Group IVa, Va, and VIa elements of Periodic Table, except titanium, and a binder metal phase consisting essentially of at least one metal selected from the group consisting of nickel and cobalt, and unavoidable impurities, the hard dispersed phase having previously been subjected to a solid solution forming treatment at a temperature of at least the sintering temperature before sintering.

15 Claims, 1 Drawing Sheet

HIGH TOUGHNESS CERMET AND A PROCESS FOR THE PRODUCTION OF THE SAME

BACKGROUND OF THE INVENTION

1. Field of the Invention

This invention relates to high hardness and high toughness nitrogen-containing sintered alloys or cermets useful for cutting tools, in particular, high speed cutting, and processes for the production of the same.

2. Description of the Prior Art

Lately, nitrogen-containing sintered hard alloys (cermets) each comprising a hard phase containing titanium carbonitride as a predominant component bonded with a binder phase of nickel and/or cobalt have been put to practical use as cutting tools.

These nitrogen-containing sintered hard alloys have been used with cemented carbides even in the field of cutting tools or cutters to which it is next impossible to apply no nitrogen-containing sintered hard alloys of the prior art, since in these nitrogen-containing sintered hard alloys, the hard phase is of much finer grains and accordingly, the high temperature creeping resistance is much more improved, as compared with the no nitrogen-containing sintered hard alloys comprising a hard phase of carbides of titanium, etc. of the prior art.

However, the nitrogen-containing sintered hard alloys of the prior art are mainly of (Ti, Ta, W, Mo)(CN)-.Ni-Co types, in which molybdenum (Mo) is regarded as an indispensable component, because molybdenum, existing in an intermediate phase between a hard phase and binder phase, is capable of protecting the hard phase from the liquid phase during sintering and controlling the grain growth of the hard phase due to dissolving and precipitating. Since the nitrogen-containing sintered hard alloys of the prior art have such a tendency that the carbonitrides contained therein are decomposed when heated in vacuum during the process for the production thereof to retain pores after sintered, the strength thereof is often less than that of the cemented carbides of the prior art. This tendency becomes more remarkable the more is the content of nitrogen. In order to prevent the carbonitrides from decomposition, it has been proposed to improve the sintering method, for example, by effecting the sintering in a nitrogen atmosphere, but the improvement of the properties is not sufficient because of, for example, segregation tendency of the nitrogen contained therein.

The above described sintered hard alloys or cermets comprising hard dispersed phases of mixed carbonitrides of titanium (Ti), tantalum (Ta), molybdenum (Mo), tungsten (W), etc., bonded with heat resisting metals such as nickel (Ni) or cobalt (Co) are favorably compared with the sintered hard alloys or cemented carbides comprising hard phases of carbides of W, Ti, Ta, etc., bonded with metals such as Co with respect to the adhesion resistance on workpieces, and thus have widely been used as a material for high speed cutting tools. However, these cermets are so hard, similarly to the cemented carbides, that the grinding machinability is bad and grinding is impossible except using diamond wheels.

Furthermore, in comparison with the cemented carbides comprising hard phases of mixed carbides of W, Ti, Ta, etc., bonded with metals such as Ni or Co according to the prior art, the above described cermets are markedly more improved in thermal fatigue resistance and toughness, so the use thereof is being enlarged to the field in which only the cemented carbides comprising tungsten carbide as a predominant component can be used.

Of late, high speed cutting has more and more been desired in the field of cutting tools, but the nitrogen-containing sintered hard alloys have the disadvantages that the crater depth occurring on the rake face of a cutting tool proceeds very rapidly in high speed cutting. In this case, the crater depth means such a phenomenon that the hard phase of a nitrogen-containing sintered hard alloy is dug out with granular unit and then allowed to fall off. In general, the crater depth can be controlled by roughening the structure of an alloy, but this controlling method is naturally limited since the hardness is lowered as the structure is roughened.

For the production of the above described cermets, a method has hitherto been employed comprising mixing powdered titanium carbonitride and powdered carbides of molybdenum, etc., pressing and forming and then sintering. Increase of the nitrogen content in the hard disperse phase has lately been carried out so as to improve the cutting property of the cermets, but a denitrification phenomenon becomes vigorous with the increase of the nitrogen content, thus lowering the sintering property. Thus, addition of a large amount of Mo is indispensable for maintaining the sintering property and the grinding machinability of the cermets becomes worse.

When using the cermets as cutting tools, in particular, these can preferably be used for finishing which needs a high surface precision, because of the good deposition resistance. Accordingly, a throwaway insert of the so-called G grade (JIS G grade precision), obtained ordinarily by subjecting a cermet tool to grinding or machining, has been used from the standpoint of the precision of a finished surface or finished dimension of a workpiece. However, since the large nitrogen content cermets which have lately been developed are very hard to be machined even by the use of a diamond wheel, these have not been put to practical use but as only M-grade throwaway inserts which are not subjected to machining as sintered and in spite of the rapid progress of the cutting property, demands for the cermets are not increasing.

In the above described cermets, the properties such as wear resistance, toughness, etc. depend largely on the composition of the hard phase, in particular, the ratio of non-metallic elements to alloyed metallic elements, as well known in the art. For example, in a cermet comprising a hard dispersed phase represented by the general formula $(Ti, M')(C,N)_m$ wherein M' is a transition metal such as Nb, Ta, Mo or W, bonded with a metal such as Ni or Co, it is known that the hardness of the cermet is monotonously increased with the increase of m, that is, the larger the value of m, the larger the hardness. Therefore, it is needless to say that m is maintained as large as possible from the standpoint of the most important wear resistance for cutting tools.

On the other hand, it is known that the equillibrium nitrogen partial pressure of $(Ti, M')(CN)_m$ is monotonously decreased with the decrease of m, that is, the smaller the value of m, the lower the equilibrium nitrogen partial pressure. When the equilibrium nitrogen partial pressure of the hard phase is higher, there takes place such a denitrification phenomenon that nitrogen gets out of the sintered compact during sintering and the thus resulting cermet is not homogeneous to warp the surfaces and sides thereof and does not satisfy the standard as a M-grade throwaway insert, since not only the nitrogen content does not reach a predetermined amount, but also the denitrification does not proceed homogeneously. From the above described reasons, the value of m must be adjusted to at most 0.80.

SUMMARY OF THE INVENTION

It is an object of the present invention to provide a cermet for a cutting tool, whose crater depth is improved by controlling the grain growth to make possible high speed cutting.

It is another object of the present invention to provide a nitrogen-containing sintered hard alloy with an improved toughness, strength and crater depth at high speed cutting as a cutting tool.

It is a further object of the present invention to provide a sintered hard alloy or cermet having a high nitrogen content, excellent cutting property when used as a cutting tool and improved grinding machinability.

It is a still further object of the present invention to provide a process for the production of a high toughness cermet with an increased crater wear resistance at high speed cutting as a cutting tool.

These objects can be attained by a high toughness cermet comprising a hard phase consisting essentially of a mixed carbonitride of Ti and at least one element selected from the group consisting of Group IVa, V and VIa elements of Periodic Table, and a binder phase consisting essentially of at least one member selected from the group consisting of Ni and Co, and unavoidable impurities, the hard phase being previously subjected to a solid solution forming treatment at a temperature of at least the sintering temperature before sintering and optionally the binder phase substantially containing no Mo.

BRIEF DESCRIPTION OF THE DRAWING

The accompanying drawing is to illustrate the principle and merits of the present invention in greater detail.

DETAILED DESCRIPTION OF THE INVENTION

Figure 1:
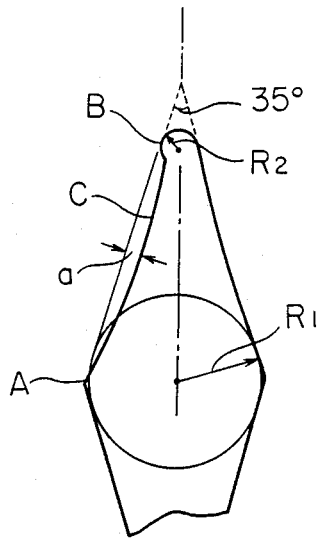
FIG. 1 is a top view of a throwaway insert made from the cermet of the present invention, in which a maximum value a of slippage from a straight line AB is shown.

The inventors have considered that improvement of the crater depth of a cermet in high speed cutting will be achieved by increasing the adhesiveness of the hard grains to the surrounding structure. To this end, the inventors have examined the adhesiveness of the hard grains and the crater depth in high speed cutting as to various cermets prepared by various methods and consequently, have found that the adhesiveness of the hard phase to the surrounding structure is increased without enlarging the grain size by the use of a mixed carbonitride prepared through a previous solid solution forming treatment and containing substantially no Mo as a starting material for the hard phase, thus resulting in a surprisingly improved crater wear resistance in high speed cutting.

That is, it is found that when using a mixed carbonitride which has previously been subjected to a solid solution forming treatment in a nitrogen atmosphere at a temperature of higher than the sintering temperature, as a raw material, the grain growth is controlled during sintering and propagation of cracks is suppressed to increase the adhesiveness of the hard phase, even if the mixed carbonitride contains no Mo. This hard phase consists essentially of a mixed carbonitride of Ti, as an essential element, and at least one element selected from the group consisting of Group IVa, V and VIa transition elements (but Mo) of Periodic Table and a binder phase consists essentially of Ni and/or Co and traces of unavoidable impurities.

Accordingly, the present invention provides a high toughness cermet comprising a hard phase consisting essentially of a mixed carbonitride of Ti and at least one element selected from the group consisting of Group IVa, Va and VIa transition elements of Periodic Table, and a binder phase consisting essentially of at least one metal selected from the group consisting of Ni and Co, and unavoidable impurities, the hard phase having previously been subjected to a solid solution forming treatment at a temperature of higher than the sintering temperature before sintering and optionally the binder phase substantially containing no Mo, in other words, containing 0 to 1% by weight of Mo.

In the prior art cermets, carbides such as TiC, TaC, WC, $Mo_2C$, etc. are used as a starting material, but since Ni or Co forming a liquid phase during sintering has a solubility of about 10 atom % for carbon, the carbides tend to be dissolved in the liquid phase and precipitated on the non-dissolved hard grains when cooled, thus resulting in grain growth, whereas in the cermets of the present invention, the mixed carbonitride which has previously been treated at a high temperature and has thus been made stable is hard to be dissolved in the liquid phase of Ni or Co having little solubility for nitrogen and accordingly, no grain growth occurs during sintering.

In the present invention, in general, Mo is not contained, but our experimental results teach that if the quantity of Mo is 1% by weight or less, an interlayer causing propagation of cracks is not formed and the crater wear resistance is improved. Therefore, by "substantially containing no Mo" in the present specification is meant that Mo is not positively added as a component of the hard phase, namely, not only the case of containing no Mo, but also the case of containing up to 1% by weight of Mo, since if the quantity of Mo contained in the whole of the nitrogen-containing sintered hard alloy is at most 1% by weight, including Mo added as an impurity from the production process, desired properties can be given.

In the cermet of the present invention, the mixed carbonitride of the hard phase is less or hardly dissolved in the binder phase, so even if metallic Ti and/or W is previously dissolved in Ni or Co for the purpose of strengthening the binder phase through formation of a solid solution, good properties can be obtained.

The feature of a first embodiment of the present invention consists in a nitrogen-containing sintered hard alloy comprising a hard phase consisting essentially of a mixed carbonitride of Ti and at least one transition element selected from the group consisting of Group IVa, Va and VIa elements of Periodic Table except Ti and a binder phase consising essentially of at least one metal selected from the group consisting of Ni and Co, and unavoidable impurities, in which the alloy does not contain a substantial quantity of Mo, the atomic ratio of nitrogen and carbon contained in the hard phase, $N/(C+N)$ is 0.3 to 0.6 and yellow to brown grains are not present or even if present, the quantity is at most 0.01% by volume.

Production of the above described nitrogen-containing sintered hard alloy is generally carried out by mixing a titanium nitride, carbide or carbonitride powder with a nitride, carbide or carbonitride powder of at least one transition element, except titanium, selected from the group consisting of Group IVa, Va and VIa elements of Periodic Table except molybdenum in such a manner that the atomic ratio of nitrogen and carbon N/(C+N) ranges from 0.3 to 0.6, subjecting previously the mixed powders to a solid solution forming treatment by heating in a nitrogen atmosphere at a temperature of at least the sintering temperature, then pulverizing the mixture to form a carbonitride powder, adding thereto Ni and/or Co powder and then sintering the resulting powder in a nitrogen atmosphere.

The nitrogen-containing sintered hard alloy can contain unavoidable impurities, for example, iron, etc. added during the production process in such a range as to affect hardly the properties and as commonly effected, carbon powder in a small amount, in general, in a proportion of 0.01 to 2.0% by weight can be added to powdered raw materials so as to improve the sintering property.

The inventors have made studies on the crater wear of the nitrogen-containing sintered hard alloy of the prior art, (Ti, Ta, W, Mo)(CN).Ni-Co type by forming cracks using a indentor of Vickers Hardness Meter and examining its propagation path and consequently, have confirmed that the cracks propagate in the interlayer between the hard layer and binder layer. Therefore, it can be considered that the crater wear resistance can be improved by removal of the interlayer, but since the interlayer consists predominantly of molybdenum carbonitride, the removal of the molybdenum component results in coarsening of the grains or grain growh and lowering of the hardness. This is a contradictory that desired properties cannot be obtained.

Furthermore, it is found that the segregation of nitrogen in the nitrogen-containing sintered hard alloy of the prior art can be confirmed by observation of yellow to brown grains in the structure of the hard phase using an optical microscope, the yellow to brown grains consisting predominantly of titanium nitride or carbonitride, and as far as these grains appear, pores tend to occur due to the decomposition thereof in high concentration parts, while the effect of nitrogen cannot sufficiently be given in low concentration parts, thus deteriorating the properties.

In this embodiment, it is made possible to improve the adhesiveness of the hard phase grains to the surrounding structure without coarsening the grains even if containing no Mo and simultaneously to disperse uniformly nitrogen, thus eliminating formation of the yellow to brown grains having appeared up to the present time, by previously forming a mixed carbonitride of Ti and at least one transition metal selected from the group consisting of Group IVa, Va and VIa metals of Periodic Table except Ti by a solid solution forming treatment, mixing the mixed carbonitride powder with Ni or Co powder in conventional manner and then sintering the resulting mixture. Carbides or carbonitrides of Group Va elements of Periodic Table, used as a raw material, have yellow to brown color, but the yellow to brown grains are extinguished by the solid solution forming treatment. If the amount of the yellow to brown grains is less than 0.01% by volume even if present, the effect of improving the strength or toughness is not deteriorated.

The reasons for limiting the atomic ratio of nitrogen and carbon N/(C+N) to a range of 0.3 to 0.6 consist in that if less than 0.3, the toughness is lowered, while if more than 0.6, the sintering property is deteriorated and nitrogen tends to segregate or if more than 0.7, yellow to brown grains appear surely.

In the case of simultaneously using Ni and Co as a binder phase, moreover, the weight ratio of Ni and Co, Ni/(Ni+Co) should preferably be 0.3 to 0.8 considering the miscibility or affinity thereof with a mixed carbonitride of the hard phase. It is desirable that this ratio is higher, but if higher than 0.8, the hardness is lowered, while if lower than 0.3, it is impossible to improve the crater wear resistance by increasing the interfacial strength.

Small amounts of zirconium (Zr), vanadium (V), chromium (Cr) and aluminum (Al) can be incorporated in the nitrogen-containing sintered hard alloy of this embodiment, as far as the merits of the present invention are not lost.

The feature of a second embodiment of the present invention consists in a high toughness cermet or nitrogen-containing sintered hard alloy comprising a hard phase consisting essentially of a mixed carbonitride of at least two transition metals selected from the group consisting of Group IVa, Va and VIa metals of Periodic Table and including Ti as a predominant essential component and W as another essential component and a binder phase consisting essentially of Ni, Co and unavoidable impurities, the weight ratio of Ni and Co, Ni/(Ni+Co) in the binder phase being 0.3 to 0.8, preferably 0.4 to 0.8 and the atomic ratio of nitrogen and carbon contained in the whole alloy, N/(C+N) being 0.3 to 0.6, preferably 0.3 to 0.55.

Production of the above decribed high toughness cermet is generally carried out by mixing nitrides, carbides or carbonitrides of transition metals composing the hard phase in such a manner that the atomic ratio of nitrogen and carbon, N/(C+N) be 0.3 to 0.6, preferably 0.3 to 0.55, previously subjecting the resulting mixture to a solid solution forming treatment in a nitrogen atmosphere to form a mixed carbonitride containing Ti as a predominant essential component and W as another essential component, mixing the thus obtained carbonitride powder with Ni and Co powders in such a manner that the weight ratio of Ni and Co, Ni/(Ni+Co) be 0.3 to 0.8, preferably 0.4 to 0.8 and then sintering the resulting mixed powder in a nitrogen atmosphere.

The powdered starting materials can contain unavoidable impurities, for example, iron, etc. added during the production process in such a range as to affect hardly the properties and as commonly effected, carbon powder can be added thereto so as to improve the sintering property.

The inventors have examined the propagation path of cracks by the foregoing hardness test and consequently, have confirmed that the cracks propagate between the hard phase and binder phase. Accordingly, the inventors have believed firmly that the crater depth of the cermet can be improved by increasing the interfacial strength of the hard phase and binder phase and have examined the affinity of the binder metals, Ni and Co with the hard phase. As a result of this examination, it is found that Ni has a stronger affinity with a carbonitride containing Ti as a predominant component, but a lower affinity with tungsten carbide, whereas Ti has the reversed affinity. Therefore, the affinity with WC is lowered with the increase of the weight ratio of Ni and Co in the binder phase, Ni/(Ni+Co) and reversely, the affinity with a carbonitride containing Ti as a predominant component is lowered with the decrease of this ratio, thus readily resulting in a crater depth.

The commercially available cermets, having a weight ratio of Ni and Co in the binder phase, Ni/(Ni+Co) of ranging from 0 to 1.0, are not satisfactory in crater depth.

The second embodiment of the present invention is based on our finding that when WC indispensable for increasing the strength of the cermet is not used as WC powder, but is subjected to a solid solution forming treatment at a temperature of at least the sintering temperature with other powdered hard materials to form a mixed carbonitride containing Ti as a predominant component and the resulting mixed carbonitride powder is mixed with Ni and Co powders and sintered, the hard phase exhibits a high affinity with both of Ni and Co.

Considering the affinity with WC, it is desirable that the weight ratio of Ni and Co, Ni/(Ni+Co) is higher, but if higher than 0.8, the hardness of the cermet is lowered, while if lower than 0.3, it is impossible to improve the crater depth by increasing the interfacial strength.

It is known in the cermets that the more the nitrogen content, the lower the sintering property, but according to the present invention, even if the nitrogen content is more, the sintering property is good and the atomic ratio of nitrogen and carbon, N/(N+C) is in the range of 0.3 to 0.6, preferably 0.3 to 0.55. If this ratio is less than 0.3, the toughness of the cermet is lowered and if more than 0.6, the wear resistance of the cermet is lowered.

However, the effect of nitrogen is only given when nitrogen is uniformly dispersed in the hard phase of the cermet. In the nitrogen-containing sintered hard alloys of the prior art, there appears segregration of nitrogen, which can be confirmed by observation of yellow to brown grains in the structure of the hard phase using an optical microscope. The yellow to brown grains consist predominantly of titanium nitride or carbonitride and as far as these grains appear, pores tend to occur in a higher concentration part of nitrogen due to the decomposition thereof, while the effect of nitrogen cannot sufficiently be given in a lower concentration part, thus deteriorating the properties.

According to the production process of this embodiment, nitrogen can uniformly be dispersed in the hard phase and there are hardly formed yellow to brown grains. If the amount of the yellow to brown grains is less than 0.01% by volume even if present, the effect of improving the strength or toughness is not deteriorated.

It is well known that if the content of nitrogen in the cermet is increased, the machinability of the cermet by a grinding wheel is remarkably lowered. The inventors have made various studies to improve the machinability and consequently, have found that the less is the components for forming the hard phase, dissolved in the binder metal, the better is the machinability. As a parameter to show the purity of Ni or Co, there is generally used a saturated magnetism. The saturated magnetism of pure Co is 2020 gauss $cm^3/g$ and that of pure Ni is 680 gauss $cm^3/g$, which are decreased with the decrease of the weight fraction of Co or Ni and with the decrease of the purity thereof. As a result of our studies, it is found that the cermet of this embodiment can give an excellent machinability when the following relationship is satisfied:

$$C \geqq 0.73 \times (20.2 \times A + 6.8 \times B)$$

wherein A=weight % of Co, B=weight %·of Ni and C=saturated magnetism (gauss $cm^3/g$) of cermet.

The feature of a third embodiment of the present invention consists in a sintered hard alloy comprising a hard phase consisting essentially of a mixed carbonitride of Ti, at least one element selected from the group consisting of Ta and Nb, and W, represented by the following general formula, $$(Ti_xM_yW_z)(C_AN_B)_m$$

wherein, in terms of atomic ratios, $x+y+z=1$, $A+B=1$, $0.5 \leqq x \leqq 0.95$, $0.01 \leqq y \leqq 0.4$, $0.01 \leqq z \leqq 0.4$, $0.1 \leqq A \leqq 0.9$, $0.1 \leqq B \leqq 0.9$, $0.85 \leqq m \leqq 1.05$ and M is at least one element selected from the group consisting of Ta and Nb, the ratio of Ta and Nb being not limited when M represents the both, and 3.0 to 40.0% by weight of a binder metal phase consisting essentially of at least one element selected from the group consisting of Ni and Co. Nb is cheap, but does not have good properties, whereas Ta is expensive, but has good properties. Thus, the ratio thereof is suitably chosen.

Production of the above described sintered hard alloy is carried out by the use of a mixed carbonitride containing Ti and W as a starting material, for example, (1) a powder of a mixed carbonitride of Ti and W, a powder of a carbide and/or nitride of Ta and/or Nb and a powder of Ni and/or Co, or (2) a powder of a mixed carbonitride of Ti and W, and Ta and/or Nb and a powder of Ni and/or Co, mixing these powders, compacting and shaping and then sintering.

The inventors have made studies of the reasons why the workability or machinability of the cermet by grinding wheels is bad and consequently, have found that the nitrogen in the hard phase and Mo and W in the binder phase, in particular, Mo constitute a major cause thereof. However, nitrogen is an important element upon which the cutting property of the cermet depends, and for the purpose of improving the cutting property, it has been carried out to increase the nitrogen content in the hard disperse phase, as described above. On the other hand, Mo and W have been considered indispensable for maintaining the sintering property by controlling the denitrification phenomenon that becomes vigorous with the increase of the nitrogen content.

The inventors have made detailed studies on the sintering phenomenon of the cermets and consequently, have found that the denitrification phenomenon during sintering takes place when a mixed carbonitride of Ti, Ta, Nb, Mo, W, etc. for the hard phase is formed, in particularly, when a carbide of W is dissolved in a carbonitride of Ti. Based on this finding, a mixed carbonitride containing Ti and W is used as a raw material powder of Ti and W in order to prevent this denitrification phenomenon, thus succeeding in obtaining a Mo-free cermet with a good sintering property as well as excellent machinability or workability.

Since the denitrification phenomenon can to a greater extent be suppressed according to this embodiment, various problems due to the denitrification phenomenon ocurring during sintering can substantially be solved even if the equilibrium nitrogen partial pressure of the hard phase is high and m can thus be adjusted to at least 0.80 in the above described general formula.

In the above described general formula representing the hard phase of the cermet, if x is less than 0.5, the wear resistance is deficient, while if more than 0.95, the sintering property is deteriorated. Ta and Nb are capable of improving the thermal fatigue resistance, but if y is less than 0.01, this capacity is hardly exhibited and if y exceeds 0.4, the wear resistance is deficient. W is indispensable for improving the sintering property and if z is less than 0.01, this effect is little, while if z exceeds 0.4, the wear resistance is deficient. Nitrogen is an essential element for improving the machinability, but if B is less than 0.1, this effect is little and if B exceeds 0.9, the sintering property is deteriorated. In a more preferable embodiment, B/(A+B) should be in the range of 0.3 to 0.6. m represents a ratio of non-metallic elements to metallic elements and if m is less than 0.85, W is increased in the binder metal phase to lower the machinability of the cermet and to decrease the hardness of the hard disperse phase, while if m exceeds 1.05, free carbon is increased in the cermet to deteriorate markedly the cutting property.

The nitrogen-containing sintered hard alloy or cermet of the present invention has a high toughness, high strength and excellent crater wear resistance when used as a cutting tool, in particular, for high speed cutting.

When the sintered hard alloy of the present invention is used as a cutting tool, a remarkably excellent cutting property can be exhibited. Thus, the sintered hard alloy of the present invention can be applied to not only M-grade throwaway inserts but also G-grade throwaway inserts for finishing cutting.

According to the process of the present invention, there can be produced a nitrogen-containing sintered hard alloy or cermet with a high nitrogen content, excellent cutting property and improved grinding machinability while keeping normal the shape of the sintered compact.

The following examples are given in order to illustrate the present invention in greater detail without limiting the same, in which percents are to be taken as those by weight unless otherwise indicated.

EXAMPLE 1

A commercially available Ti(CN) with a mean grain size of about 2 μm was mixed with TaC powder and WC powder each having substantially the same grain size in a ball mill and then subjected to a solid solution forming treatment in a nitrogen stream at a nitrogen partial pressure of 400 torr and a temperature of 1700° C. for 1 hour to form a mixed carbonitride $(Ti_{0.88}Ta_{0.05}W_{0.07})(C_{0.52}N_{0.48})_{0.94}$. In this mixed carbonitride, N/(C+N)=0.48 and it was found by the X-ray diffraction that the peaks of TaC and WC disappeared.

The resulting mixed carbonitride was ball milled and 85% of this powder was mixed with 7.9% of Ni powder and 7% of Co powder (Ni/(Ni+Co)=0.53) and 0.1% of free carbon, mixed with 3% of camphor, based on the resulting mixture and formed by compacting. The resulting compact was sintered in a nitrogen stream at a nitrogen partial pressure of 10 torr and a temperature of 1450° C. for 1 hour to prepare a cermet (Sample No. 1).

80% of the mixed carbonitride prepared in the same manner as described above was mixed with 5% of $Mo_2C$ powder, 7.9% of Ni powder, 7% of Co powder and 0.1% of free carbon and from this mixed powders, a cermet (Sample No. 2) was prepared under the same conditions as described above.

The same Ti(CN) powder, TaC powder and WC powder, as described above, were mixed with Ni powder, Co powder and free carbon powder without subjecting to the solid solution forming treatment and then subjected to preparation of a cermet having the same composition as Sample 1 (Sample No. 3). Furthermore, from the mixed powders to which $Mo_2C$ powder was added, a cermet (Sample No. 4) having the same composition as Sample No. 2 was prepared.

When the structure of each of the thus resulting cermets was polished in a mirror surface and observed by an optical microscope (magnification: 1500 times), there were found yellow to brown grains independent and clearly different in color tone from the mixture of the binder metal and carbonitride in the hard phase in the case of Cermet Sample Nos. 3 and 4, but no such grains in the case of Cermet Sample Nos. 1 and 2.

Furthermore, each of the cermet samples was subjected to measurement of the hardness (Hv), fracture toughness ($K_{IC}$) and transverse rupture strength (kg/mm²) and measurement of the crater depth and flank wear under Cutting Conditions I shown in Table 1 and the ratio of failure on the edge under Cutting Conditions 2 shown in Table 1, thus obtaining results as shown in Table 2. From the results of Table 2, it is apparent that Cermet Sample No. 1, in particular, of the present invention is more excellent in toughness and wear resistance and has a higher strength and hardness.

TABLE 1

| | Cutting Condition 1 | Cutting Condition 2 |
|---|---|---|
| Workpiece | SCM 435 (Hs = 40) | SCM 435 (Hs = 40), round rod with 4 grooves in longitudinal direction |
| Cutting Speed (m/min) | 200 | 100 |
| Feed (mm/rev) | 0.36 | 0.36 |
| Cutting Depth (mm) | 1.5 | 2.0 |
| Shape of Tool | SNMN 120408 | same as left |
| Holder | FN 11 R - 44 A | same as left |
| Cutting Fluid | not used | not used |
| Cutting Time | 10 min | 30 sec, 32 times |

TABLE 2

| | Characteristics | | Properties | | | Cutting Properties | | |
|---|---|---|---|---|---|---|---|---|
| | | | | | | Cutting Condition 1 | | Cutting Condition 2 |
| Sample No. | Mixed Carbonitride in Hard Phase | Mo—content | Hardness (Hv) | Fracture Toughness $K_{IC}$ (MN/M$^{3/2}$) | Strength TRS (kg/mm²) | Crater Depth (mm) | Flank Wear (mm) | Ratio of Failure (%) |
| 1 | yes | no | 1600 | 8.5 | 200 | 0.05 | 0.08 | 18 |
| 2 | yes | yes | 1630 | 5.5 | 180 | 0.23 | 0.08 | 72 |
| 3 | no | no | 1300 | 9.0 | 180 | too worn to be measured | | 9 |

TABLE 2-continued

| Sample No. | Characteristics: Mixed Carbonitride in Hard Phase | Characteristics: Mo—content | Properties: Hardness (Hv) | Properties: Fracture Toughness $K_{IC}$ ($MN/M^{3/2}$) | Properties: Strength TRS ($kg/mm^2$) | Cutting Properties: Cutting Condition 1: Crater Depth (mm) | Cutting Properties: Cutting Condition 1: Flank Wear (mm) | Cutting Properties: Cutting Condition 2: Ratio of Failure (%) |
|---|---|---|---|---|---|---|---|---|
| 4 | no | yes | 1550 | 5.5 | 180 | 0.25 | 0.12 | 77 |

EXAMPLE 2

Cermet Sample Nos. 5 to 14 shown in Table 3 were prepared in an analogous manner to Cermet Sample No. 1 and Cermet Sample No. 3 except changing the ratio of carbon and nitrogen of Ti(CN) powder to change the ratio of N/(C+N) of the mixed carbonitride formed.

The thus prepared cermet samples were subjected to measurement of the properties, namely, hardness, fracture toughness and strength (TRS) and measurement of the cratr depth and flank wear under Cutting Conditions 1 shown in Table 1 and the ratio of failure on the edge under Cutting Conditions 2 shown in Table 1, thus obtaining results as shown in Table 4. From the results of Table 4, it is apparent that the cermets of the present invention are more excellent in toughness, strength, wear resistance and crater depth.

When the structure of each of the cermet samples was observed by an optical microscope (magnification: 1500 times) in an analogous manner to Example 1, there were found yellow to brown grains in Sample Nos. 10, 11 and 12.

TABLE 3

| Sample No. | (% by weight) (TiTaW)CN | TiCN | TaC | WC | Ni | Co | C | Ni/(Ni + Co) | N/(C + N) |
|---|---|---|---|---|---|---|---|---|---|
| 5 | 79.5 | — | — | — | 5 | 15 | 0.5 | 0.25 | 0.45 |
| 6 | 79.5 | — | — | — | 8 | 12 | 0.5 | 0.4 | 0.45 |
| 7 | 79.5 | — | — | — | 10 | 10 | 0.5 | 0.5 | 0.45 |
| 8 | 79.5 | — | — | — | 12 | 8 | 0.5 | 0.6 | 0.45 |
| 9 | 79.5 | — | — | — | 20 | — | 0.5 | 1.0 | 0.45 |
| 10* | — | 55.5 | 8 | 16 | 8 | 12 | 0.5 | 0.4 | 0.45 |
| 11* | — | 55.5 | 8 | 16 | 12 | 8 | 0.5 | 0.6 | 0.45 |
| 12* | 79.5 | — | — | — | 10 | 10 | 0.5 | 0.5 | 0.65 |
| 13* | 79.5 | — | — | — | 10 | 10 | 0.5 | 0.5 | 0.25 |
| 14 | 79.5 | — | — | — | 10 | 10 | 0.5 | 0.5 | 0.55 |

Note:
*Sample for comparison

TABLE 4

| Sample No. | Hardness (Hv) | Fracture Toughness $K_{IC}$ ($MN/m^{3/2}$) | Strength (TRS) ($kg/mm^2$) | Crater Depth (mm) | Flank Wear (mm) | Ratio of Failure (%) |
|---|---|---|---|---|---|---|
| 5 | 1450 | 5.5 | 210 | 0.31 | 0.09 | 38 |
| 6 | 1430 | 7.1 | 220 | 0.10 | 0.10 | 25 |
| 7 | 1425 | 7.6 | 220 | 0.07 | 0.09 | 20 |
| 8 | 1400 | 7.8 | 215 | 0.07 | 0.09 | 18 |
| 9 | 1330 | 9.0 | 200 | 0.08 | 0.18 | 15 |
| 10* | 1450 | 5.2 | 180 | 0.41 | 0.12 | 58 |
| 11* | 1410 | 5.8 | 175 | 0.30 | 0.17 | 41 |
| 12* | 1420 | 4.8 | 160 | 0.28 | 0.21 | 18 |
| 13* | 1470 | 6.2 | 190 | 0.07 | 0.08 | 53 |
| 14 | 1430 | 7.5 | 240 | 0.15 | 0.14 | 18 |

Note:
*Sample for comparison

EXAMPLE 3

Cermet Sample Nos. 15 and 16 were prepared in an analogous manner to Example 1 except adding and dissolving 1% of metallic W powder (Sample No. 15) and 1% of metallic Ti powder (Sample No. 16) to the binder phase without changing the volume ratio and Ni/(Ni+Co) ratio of the binder phase in Cermet Sample No. 1 of Example 1.

When each of the resulting cermets was subjected to a cutting test under the following Cutting Condition 3, the quantity of plastic deformation of the edge was 0.06 mm in the case of Cermet Sample No. 1, whereas it was 0.03 mm in the case of Cermet Sample Nos. 15 and 16.

It will clearly be understood from this result that dissolving of W and Ti in the binder phase is effective for improving the property of the cermet.

| Cutting Conditions 3 | |
|---|---|
| Workpiece | SCM 435 (Hs = 40) |
| Cutting Speed (m/min) | 120 |
| Feed (mm/rev) | 0.70 |
| Cutting Depth (mm) | 2.0 |
| Shape of Tool | SNMN 120408 |
| Holder | FN 11R-44A |
| Cutting Fluid | not used |
| Cutting Time | 3 min |

EXAMPLE 4

A commercially available Ti(CN) powder, TaC powder and WC powder were mixed and heat treated in a nitrogen stream at a pressure of 200 torr and at a temperature of 1650° C. for 1 hour to form a mixed carbonitride, which was then ball milled, mixed with Ni powder and Co powder and then with paraffin, and pulverized and mixed by wet process in hexane. The resulting slurry was then dried and granulated by an atomizer.

The mixed powder was pressed in the form of an insert of SNG 432 at a pressure of 2 ton/cm$^2$, heated in vacuum up to 1200° C., further heated in a nitrogen stream at a pressure of 15 torr at a temperature of 1200° C. to 1450° C. and maintained at 1450° C. for 1 hour, thus obtaining a cermet with a composition of $(Ti_{0.8}Ta_{0.07}W_{0.05})(C_{0.51}N_{0.49})_{0.95}$-7% Ni-7% Co (Sample No. 17).

In Comparative Example 1, a cermet having the same composition as described above was prepared by similarly sintering a commercially available Ti(CN) powder, TaC powder, WC powder, Ni powder and Co powder and in Comparative Example 2, a commercially available cermet (T 25 A-commercial name-manufactured by Sumitomo Electric Industries, Ltd.) was used. (Sample Nos. 18 and 19)

To examine the grinding machinability of these cermets, the side of each of the inserts was subjected to grinding under same conditions using an NC grinder. The inserts of Example 4 (Sample No. 17) and Comparative Example 1 (Sample No. 18) needed one dressing per 2 hours, while the insert of Comparative Example 2 (Sample No. 19) needed one dressing per 36 minutes.

The each insert was then subjected to a cutting test under the following cutting conditions:

| Cutting Conditions 4 | |
|---|---|
| Workpiece | SCM 435 ($H_B$ = 230) 100 × 100 mm square |
| Cutter | DNF 4160 R |
| Cutting Speed | 150 m/min |
| Feed | 0.25 mm/rev |
| Cutting Depth | 2.5 mm |
| Cutting Fluid | water-soluble cutting fluid |

As a results of this test, it was found that the insert of Example 4 (Sample No. 17) showed a flank wear of 0.12 mm by cutting for 10 minutes, but the insert of Comparative Example 1 (Sample No. 18) met with chipping by cutting for 10 minutes during which the flank wear reached 0.28 mm and the insert of Comparative Example 2 (Sample No. 19) met with chipping by cutting for 6 minutes 28 seconds.

EXAMPLE 5

Using a commercially available Ti(CN) powder, TaNbC powder and WC powder, a mixed carbonitride was formed in an analogous manner to Example 4 and similarly, a cermet in the form of an insert was prepared having a composition of $(Ti_{0.8}Ta_{0.04}Nb_{0.03}W_{0.05})(C_{0.5}N_{0.5})_{0.96}$-7% Ni-7% Co (Sample 20).

In a similar test of the grinding machinability to Example 4, one dressing per 2 hours was quite enough and in a cutting test, the flank wear reached 0.14 mm by cutting in 10 minutes.

EXAMPLE 6

A commercially available Ti(CN) powder and WC powder were mixed and heat treated in a nitrogen stream at 200 torr and 1600° C. for 1 hour to form a carbonitride, which was then ball milled, mixed with TaNbC powder, Ni powder and Co powder and then with paraffin, and pulverized and mixed by wet process in hexane. The resulting slurry was then dried and granulated by the use of an atomizer.

The resulting powder was sintered in an analogous manner to Example 4 in the form of an insert of SPG 422, thus obtaining a cermet with a composition of $(Ti_{0.88}Ta_{0.04}Nb_{0.03}W_{0.05})(C_{0.49}N_{0.51})_{0.97}$-5.5% Ni-5.5% Co (Sample No. 21).

In Comparative Example 3, a commercially available cermet (T 12 A-commercial name-manufactured by Sumitomo Electric Industries, Ltd.) was used (Sample No. 22).

The cermet of Example 6 (Sample No. 21) showed a similar grinding machinability to Sample No. 17 of Example 4.

The each insert was then subjected to a cutting test under the following cutting conditions:

| Cutting Conditions 5 | |
|---|---|
| Workpiece | S 45 C ($H_B$ = 280) |
| Cutting Speed | 170 m/min |
| Feed | 0.10 mm/rev |
| Cutting Depth | 0.1 mm |
| Holder | FP 21 R-44A |
| Cutting Fluid | water-soluble fluid |

As a result of this test, it was found that the insert of Example 6 (Sample No. 21) showed a flank wear of 0.08 mm by cutting for 30 minutes, whereas the insert of Comparative Example 3 (Sample No. 22) showed a flank wear of 0.18 mm.

On the other hand, the above described procedure of Example 6 was repeated except using Mo powder to substitute a part of the WC powder, thus obtaining a cermet with a composition of $(Ti_{0.88}Ta_{0.04}Nb_{0.03}Mo_{0.02}W_{0.03})(C_{0.55}N_{0.45})_{0.91}$-5.5% Ni-5.5% Co (Sample No. 23).

In Comparative Example 4, a cermet with the same composition as Sample No. 23 was prepared by the prior art method using no mixed carbonitride (Sample No. 24).

When these inserts (Sample Nos. 23 and 24) were similarly subjected to the test of the cutting property and grinding machinability, Sample No. 23 showed a flank wear of 0.05 mm by cutting in 30 minutes in the former test and needed one dressing per 12 minutes in the latter test, but Sample No. 24 showed chipping by cutting for 26 minutes 38 seconds in the former test and needed one dressing per 21 minutes in the latter test.

EXAMPLE 7

A commercially available Ti(CN) powder and WC powder were mixed and subjected to a heat treatment in a nitrogen atmosphere at 200 torr and 1600° C. for 1 hour to form a mixed carbonitride, which was then ball milled, mixed with NbN powder and Ni powder and further with paraffin, and pulverized and mixed by wet process in ethyl alcohol. The resulting slurry was then dried and granulated by the use of an atomizer.

The thus obtained powder was pressed and formed in the form of an insert SDKN 43 TR, then heated in vacuum up to 1200° C., heated in a nitrogen stream at 10 torr and 1200° to 1380° C. and maintained in a nitrogen stream at 5 torr and 1380° C., after which a sintering furnace was once evacuated to vacuum and then cooled to room temperature in a CO stream at 15 torr, thus obtaining a cermet with a composition of $(Ti_{0.80}Nb_{0.15}W_{0.05})(C_{0.5}N_{0.42})_{0.95}$-12% Ni (Sample 25).

In Comparative Example 5, a commercially available cermet (T 25 A-commercial name-manufactured by Sumitomo Electric Industries, Ltd.)(Sample No. 19) was used.

These inserts (Sample No. 25 and 19) were subjected to a cutting test under the following conditions:

| Cutting Conditions 6 | |
|---|---|
| Workpiece | S 45 C ($H_B$ = 250) 50 mm × 100 mm square |
| Cutter | FPG 4160 R |
| Cutting Speed | 180 m/min |
| Feed | 0.12 mm/rev |
| Cutting Depth | 3 mm |

-continued

| Cutting Conditions 6 | |
|---|---|
| Cutting Fluid | water-soluble fluid |

The insert of Example 7 showed a flank wear of 0.08 mm by cutting for 10 minutes, but that of Comparative Example 5 was broken by thermal crack at cutting for 8 minutes 13 seconds.

EXAMPLE 8

A commercially available Ti(CN) powder, TaC powder and WC powder were mixed and heat treated in a nitrogen flow at 100 torr and 1600° C. for 2 hours to form a mixed carbonitride, which was then ball milled so as to give a specific surface area, measured by BET, of at least 1 $m^2/g$, mixed with Ni powder, Co powder and paraffin and pulverized and mixed by wet process in ethyl alcohol. The resulting slurry was spray dried and granulated by an atomizer.

The thus obtained powder was pressed at a pressure of 1.5 $tons/cm^2$ and formed in a compact of VNMG 442, heated in vacuum up to 1150° C., further heated in a nitrogen flow at 20 torr up to 1425° C., sintered at the same temperature for 40 minutes and then cooled to room temperature in a nitrogen flow at 15 torr, thus obtaining a cermet with a composition of $(Ti_{0.8}Ta_{0.07}W_{0.05})(C_{0.56}N_{0.44})_{0.9}$-6% Ni-6% Co (Sample No. 26).

In Comparison Example 6, on the other hand, a commercially available Ti(CN) powder, TaC powder, WC powder, Ni powder and Co powder were mixed by wet process as they were in conventional manner and then sintered in the similar manner to Example 8 (Sample No. 27).

In addition, the procedures of Example 8 and Comparative Example 6 were repeated except changing the quantity of carbon added and nitrogen partial pressure during sintering to obtain insert samples of the present invention and for comparison, in which m was adjusted to various values (Sample Nos. 28 to 37).

Each of the thus resulting cermet samples (Sample Nos. 26–37) was then subjected to a cutting test under the following cutting conditions:

| Cutting Conditions 7 | |
|---|---|
| Workpiece | SCM 435 ($H_B$ = 250) |
| Cutting Speed | 180 m/min |
| Feed | 0.36 mm/rev |
| Cutting Depth | 2.0 mm |
| Cutting Time | 5 minutes |
| Cutting Fluid | not used |

The results of this cutting test are shown in Table 5 with data of the straightness of the edge portion of DNMG 442 insert, in which "a" represents a slippage from the straight line AB as a maximum value of the sintered insert in a top view of a throwaway insert DNMG 442 shown in FIG. 1, that is, represents the straightness of the edge portion of an insert, (+) being a slippage toward the inside and (−) being that toward the outside.

TABLE 5

| Sample No. | m | Test Results ($V_B$) | a |
|---|---|---|---|
| 28 | 0.96 | 0.04 mm | less than 0.01 mm |
| 26 | 0.90 | 0.05 | " |
| 29 | 0.88 | 0.08 | " |

TABLE 5-continued

| Sample No. | m | Test Results ($V_B$) | a |
|---|---|---|---|
| 30 | 0.86 | 0.09 | " |
| 31 | 0.83 | 0.12 | " |
| 32 | 0.80 | 0.16 | " |
| 33* | 0.92 | 0.06 | 0.12 mm |
| 27* | 0.90 | 0.07 | 0.10 |
| 34* | 0.86 | 0.12 | 0.09 |
| 35* | 0.80 | 0.15 | 0.06 |
| 36* | 0.76 | 0.22 | 0.02 |
| 37* | 0.69 | 0.28 | 0.01 |

Note:
*for comparison

EXAMPLE 9

Mixed carbonitrides of transition metals were prepared in an analogous manner to Example 1 except using the following compositions (Sample Nos. 38 to 43):

Sample No. 38: 80% TiCN-20% WC
Sample No. 39: 72% TiCN-20% WC-8% $Mo_2C$
Sample No. 40: 64% TiCN-8% TaC-20% WC-8% $Mo_2C$
Sample No. 41:
Sample No. 42: 64% TiCN-8% TaC-18% WC-8% $Mo_2C$-2% ZrN
Sample No. 43: 64% TiCN-8% NbC-18% WC-8% $Mo_2C$-2% ZrN From these mixed carbonitrides, cermets were prepared in an analogous manner to Example 1 except using the recipes shown in Table 6:

TABLE 6

| Sample No. | Mixed Carbonitride | Ni | Co | C | Ni/(Ni + Co) | N/(N + C) |
|---|---|---|---|---|---|---|
| 38 | 79.5 | 10 | 10 | 0.5 | 0.50 | 0.45 |
| 39 | 79.5 | 10 | 10 | 0.5 | 0.50 | 0.45 |
| 40 | 84.5 | 7 | 8 | 0.5 | 0.47 | 0.40 |
| 41 | 79.5 | 10 | 10 | 0.5 | 0.50 | 0.45 |
| 42 | 79.5 | 10 | 10 | 0.5 | 0.50 | 0.45 |
| 43 | 79.5 | 10 | 10 | 0.5 | 0.50 | 0.45 |

The resulting cermet samples were then subjected to measurement of the hardness (Hv) and fracture toughness ($K_{IC}$), the crater depth (mm) and flank wear (mm) under Cutting Conditions 1 shown in Table 1 and the failure ratio (%) under Cutting Conditions 2 in Table 1, thus obtaining results as shown in Table 7:

TABLE 7

| Sample No. | Hardness (Hv) | Fracture Toughness ($K_{IC}$) | Crater Depth (mm) | Flank Wear (mm) | Failure Ratio (%) |
|---|---|---|---|---|---|
| 38 | 1500 | 5.8 | 0.08 | 0.12 | 40 |
| 39 | 1510 | 6.0 | 0.07 | 0.13 | 38 |
| 40 | 1530 | 6.5 | 0.06 | 0.10 | 29 |
| 41 | 1410 | 8.7 | 0.16 | 0.22 | 4 |
| 42 | 1570 | 6.5 | 0.07 | 0.09 | 30 |
| 43 | 1560 | 6.3 | 0.10 | 0.10 | 32 |

EXAMPLE 10

The procedure of Example 9, in particular, corresponding to Sample Nos. 40 and 41 was repeated except changing the quantity of saturated magnetism as shown in Table 8 to prepare Sample Nos. 44 to 47 which were then subjected to a grinding test under conditions shown in the following. The results are shown in Table 8, from which it is evident that the higher the saturated magnetism, the more excellent the grinding machinability or workability.

TABLE 8

| Sample No. | Saturated Magnetism (gauss $cm^3/g$) | Grinding Resistance in Normal Direction $F_N$ (N/mm) |
|---|---|---|
| 40 | 175 | 150 |
| 44 | 130 | 180 |
| 45 | 100 | 225 |
| 41 | 208 | 187 |
| 46 | 185 | 230 |
| 47 | 125 | 280 |

| Grinding Test Conditions | |
|---|---|
| Grinding Wheel | resin-bonded diamond wheel No. 200 |
| Grinding Method | surface flange grinding |
| Grinding Speed | 40 m/sec |
| Feed | 0.20 mm/sec |
| Grinding Depth | 0.02 mm |

What is claimed is:

1. A high toughness cermet comprising a hard phase consisting essentially of a mixed carbide represented by the general formula $(Ti_xM_yW_z)(C_AN_b)m$ in which, in terms of atomic ratios, $x+y+z=1$, $A+B=1$, $0.5 \leqq x \leqq 0.95$, $0.01 \leqq y \leqq 0.4$, $0.01 \leqq z \leqq 0.4$, $0.1 \leqq A \leqq 0.9$, $0.1 \leqq B \leqq 0.9$, $0.85 \leqq m \leqq 1.05$ and M is at least one element selected from the group consisting of Ta and Nb and a binder phase consisting essentially of at least one metal selected from the group consisting of Ni and Co, and unavoidable impurities, the atomic ratio of nitrogen and carbon contained in the cermet, $N/(C+N)$ is in the range of 0.3 to 0.6, said hard phase having previously been subjected to a solid solution forming treatment at a temperature of at least the sintering temperature before sintering.

2. The high toughness cermet as claimed in claim 1, wherein a substantial quantity of Mo is not contained in the cermet.

3. The high toughness cermet as claimed in claim 1, wherein Mo is contained in a proportion of 0 to 1% by weight in the cermet.

4. The high toughness cermet as claimed in claim 1, wherein at least one element selected from the group consisting of Ti and W is dissolved in the binder phase.

5. The high toughness cermet as claimed in claim 2, wherein the atomic ratio of nitrogen and carbon contained in the hard phase, $N/(C+N)$ is in the range of 0.3 to 0.6.

6. The high toughness cermet as claimed in claim 1, wherein the binder phase consists of Ni and Co in a $Ni/(Ni+Co)$ ratio by weight of 0.3 to 0.8.

7. The high toughness cermet as claimed in claim 1, wherein the mixed carbonitride of the hard phase contains Ti and W as essential components.

8. The high toughness cermet as claimed in claim 7, wherein the atomic ratio of nitrogen and carbon contained in the hard phase, $N/(N+C)$ is in the range of 0.3 to 0.6 and the binder phase consists of Ni and Co in a $Ni/(Ni+Co)$ ratio by weight of 0.3 to 0.8.

9. The high toughness cermet as claimed in claim 6, wherein the relationship of $C \geqq 0.73 \times (20.2 \times A + 6.8 \times B)$ wherein A=weight % of Co, B=weight % of Ni and C=saturated magnetism (gauss $cm^3/g$) is satisfied.

10. The high toughness cermet as claimed in claim 1, wherein A and B satisfy the relationship of $0.3 \leqq B/(A+B) \leqq 0.6$.

11. The high toughness cermet as claimed in claim 1, wherein the hard phase is bonded with 3 to 40% by weight of a binder phase consisting essentially of at least one element selected from the group consisting of Ni and Co.

12. A process for the production of the high toughness cermet as claimed in claim 1, which comprises mixing at least one member selected from the group consisting of nitrides, carbides, carbonitrides of Ti and mixtures thereof with at least one member selected from the group consisting of nitrides, carbides, carbonitrides of at least one transition metal selected from the group consisting of Group IVa, Va and VIa metals of Periodic Table except Ti and mixtures, thereof, heating previously the mixed powders in a nitrogen atmosphere at a temperature of at least the sintering temperature to form a solid solution, then pulverizing the solid solution to obtain a carbonitride powder, mixing the carbonitride powder with at least one metal selected from the group consisting of Ni and Co and then sintering the mixture in a nitrogen atmosphere.

13. The process as claimed in claim 12, wherein the mixing and heating are carried out in such a manner that the solid solution has an $N/(C+N)$ atomic ratio of 0.3 to 0.6.

14. The process as claimed in claim 12, wherein the mixed powders further contain 0.01 to 2% by weight of carbon powder.

15. The process as claimed in claim 12, wherein the carbonitride powder is mixed with Ni and Co in a $Ni/(Ni+Co)$ weight ratio of 0.3 to 0.8.

* * * * *